United States Patent [19]

Celeste

[11] 4,140,224

[45] Feb. 20, 1979

[54] SHELF PROTECTOR WITH TAG ASSEMBLY

[76] Inventor: Lawrence S. Celeste, 1561 Birch, Hanover Park, Ill. 60103

[21] Appl. No.: 783,545

[22] Filed: Apr. 1, 1977

Related U.S. Application Data

[63] Continuation-in-part of Ser. No. 683,837, May 6, 1976, Pat. No. 4,073,384.

[51] Int. Cl.[2] ..... A47F 7/00

[52] U.S. Cl. ..... 211/134; 40/10 R; 40/16.2

[58] Field of Search ..... 211/134, 135, 49 D, 211/49 S, 153; 40/10 R, 10 D, 11 R, 16, 16.2, 16.4

[56] References Cited

U.S. PATENT DOCUMENTS

| | | | |
|---|---|---|---|
| 2,163,985 | 6/1939 | Roberts | 108/90 |
| 2,763,947 | 9/1956 | Hopp et al. | 40/10 R |
| 2,950,554 | 8/1960 | Foster | 40/16.2 |
| 3,228,131 | 1/1966 | Heck | 40/10 R |
| 3,313,054 | 4/1967 | Madey | 40/10 R |
| 3,320,690 | 5/1967 | Forsburg | 40/16.2 |
| 3,889,408 | 6/1975 | Offner | 40/10 R |

FOREIGN PATENT DOCUMENTS

| | | | |
|---|---|---|---|
| 1347704 | 11/1963 | France | 40/10 R |

*Primary Examiner*—Roy D. Frazier
*Assistant Examiner*—Terrell P. Lewis
*Attorney, Agent, or Firm*—Hill, Gross, Simpson, Van Santen, Steadman, Chiara & Simpson

[57] ABSTRACT

A shelf protector and tag assembly is provided for use on a shelf surface which supports merchandise. A shelf protector is provided having a planar surface which is receivable on the shelf surface to be protected and a lip portion which overhangs an outer edge of the shelf being protected. A tag holding member is attached by a support member to the lip portion of the shelf protector for displaying removable tags containing merchandise related indicia.

1 Claim, 5 Drawing Figures

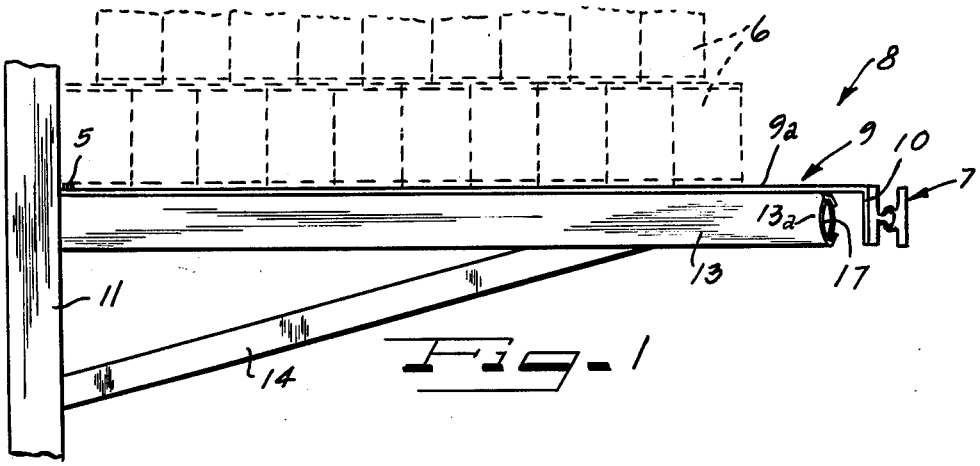
Fig. 1
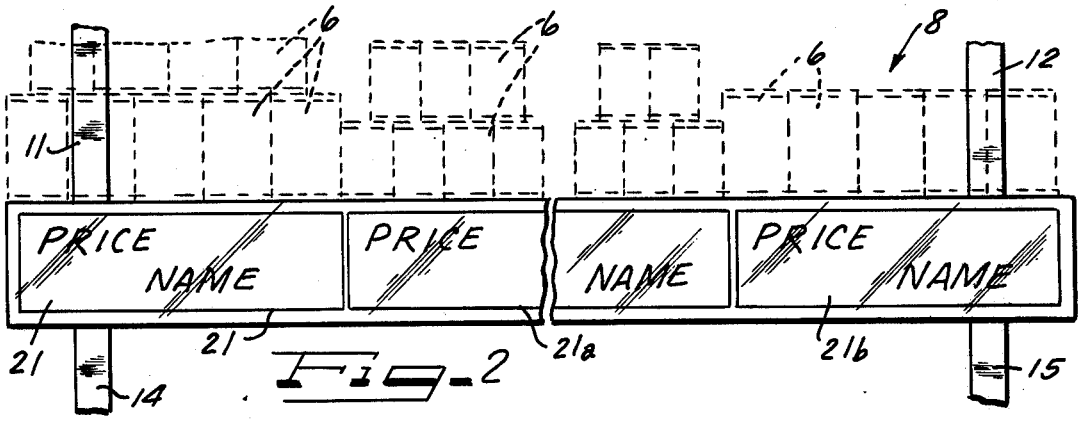
Fig. 2
Fig. 3
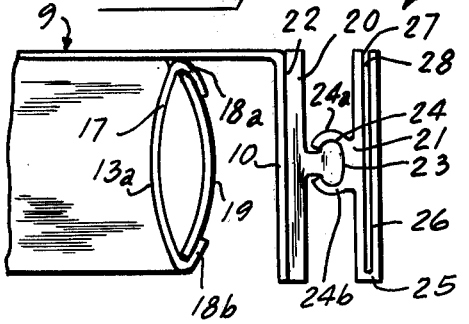
Fig. 4
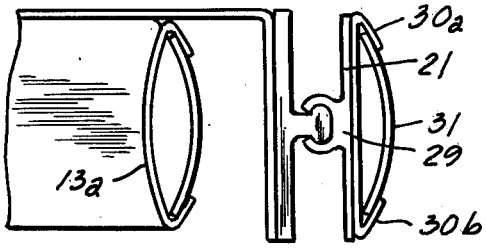
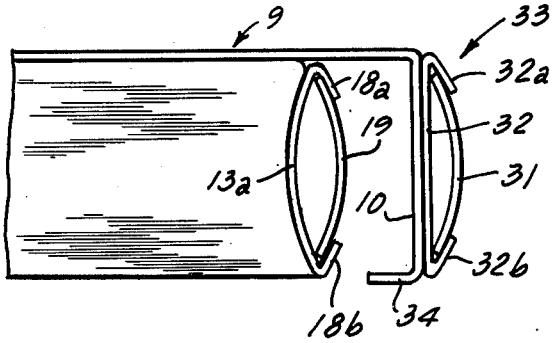
Fig. 5

SHELF PROTECTOR WITH TAG ASSEMBLY

RELATED APPLICATION

This application is a continuation-in-part of my earlier filed and pending application U.S. Ser. No. 683,837 filed on May 6, 1976, now U.S. Pat. No. 4,073,384, issued Feb. 14, 1978.

BACKGROUND OF THE INVENTION

This invention relates to shelf protectors and tags containing merchandise related indicia.

It is known to provide shelves supporting merchandise such as food and beverage items in a supermarket wherein an outer edge wall of the shelves supports a strip for retaining tags with merchandise description indicia. Such tags typically may indicate the price of an item, a code number for the item, or a name of the item. The tag supporting holders are provided as elongated strips having lips for retaining merchandise indicia identifying tags and may additionally have a plastic cover to protect the tags from destruction.

It is desirable to provide a shelf protector for shelves displaying merchandise since the cost of replacement of such shelves after years of use may be very high. However, if a shelf protector is used having an overhanging lip, then the merchandise indicia tag supporting strips and the tags mounted thereon would be hidden from view. Furthermore, it may be desirable to replace the system used to display the tags but again the cost of removing the old system and installing the new one would be prohibitive.

SUMMARY OF THE INVENTION

It is an object of this invention to provide a shelf protector for covering shelves supporting merchandise wherein the shelf protector also includes members for display of merchandise indicia tags.

It is a further object of this invention to provide a shelf protector which has an assembly for displaying merchandise information tags wherein the tags and/or the supporting members are easily removable.

It is another object of this invention to provide a protected shelf and tag assembly for use on a shelf projecting outwardly from a shelf supporting post. Typically, the shelf supports merchandise and has an outer edge wall upon which a merchandise identifying tag supporting strip may be positioned. A shelf protector which is preferably removable is provided which has a planar surface receivable on the merchandise supporting surface of the shelf. A lip portion of the shelf protector overhangs the outer edge wall of the shelf. A tag holding system is attached to the lip portion for displaying removable tags containing merchandise related indicia.

By providing the tag holding assembly on the shelf protector, the original shelf may be easily protected without replacement and without the need to remove old tag supporting strips or change tags.

BRIEF DESCRIPTION OF THE DRAWINGS

FIG. 1 is a side view of the shelf protector and tag assembly of this invention;

FIG. 2 is a front view of the shelf protector and tag assembly illustrated in FIG. 1;

FIG. 3 is an enlarged view of the front lip portion and tag mounting members of the shelf protector and tag assembly of FIG. 1;

FIG. 4 is an alternate embodiment of the tag support member shown in FIG. 3; and FIG. 5 is a side view of an alternate embodiment of the tag holding assembly of FIG. 1.

DESCRIPTION OF THE PREFERRED EMBODIMENTS

FIGS. 1 and 2 illustrate by reference numeral 8 the shelf protector and tag assembly of this invention. Vertical support posts 11 and 12 are provided from which a shelf 13 projects at substantially right angles. Support brackets 14 and 15, respectively attached to the vertical posts 11 and 12 support the shelf 13 in position. A shelf protector 9 which is removable and may be secured in place by fastening members 5 such as screws, is comprised of a substantially planar sheet-like protecting surface 9*a* disposed over a top surface of the shelf 13. An overhanging lip 10 at approximately right angles to the surface 9*a* is also provided as part of the shelf protector 9. Lip 10 covers the leading edge wall 13*a* of the shelf 13 and also serves as a mounting point for a tag assembly shown generally at 7. Merchandise 6 on display rests on the protecting surface 9*a* of the shelf protector 9.

Referring to FIGS. 2 and 3, an old tag support strip member 17 is shown on the edge wall 13*a* of the shelf 13. This old strip 17 may have supporting lips 18*a* and 18*b* which retain a removable tag 19 originally installed on the shelf 13. As can be seen from FIG. 3, the new tag assembly 7 overlaps the old tag support strip member 17. This new tag assembly 7 has a support member 20 which is preferably an elongated strip covering the outwardly facing surface of the overhanging lip 10. An adhesive backing 22 on the support member 20 binds the same to the lip surface. An elongated locking protrusion 23 which preferably has a semi-oval cross-sectional shape is provided centrally along the longitudinal central axis of the support member 20. A tag holding member 21 having a reciprocal or mating locking channel 24 slides over the locking protrusion 23. The locking channel 24 is formed of curved arms 24*a* and 24*b* which surround the periphery of the locking protrusion 23. The tag holding member 21 preferably has a rectangular body portion 25 with a pocket 26 for receiving new tags 28 through an opening 27.

As shown in FIG. 2, a plurality of the tag holding members 21, 21*a*, 21*b*, etc. may be slidably received over the locking protrusion 23. Each of these may contain price and name indicia corresponding to the merchandise 6 being displayed on the new tags 28.

In an alternate embodiment of the invention shown in FIG. 4, the tag holding member 21 may have a tag support strip member 29 mounted thereon with elongated supporting lips 30*a* and 30*b* at the top and bottom portions of the strip member 29. With this embodiment, a flexible tag 31 may be fitted between the lips 30*a* and 30*b* to be retained thereby.

FIG. 5 discloses another embodiment for a tag assembly 33 to be mounted on the lip 10 of the shelf protector 9. In this embodiment, an elongated strip preferably of metal is attached to the outward facing surface of the lip 10. The strip 32 has upper and lower tag supporting lips 32*a* and 32*b* which retain a tag 31 in the tag strip holding member 32. Engagement of the tag 31 under the lips 32*a* and 32*b* is accomplished by pinch flexing the tag 31 until the upper and lower edges fit under the lip. The strip 32 may be attached to the overhanging lip 10 of the shelf protector 9 by welding or other convenient fastening methods. An inturned lip 34 on the bottom of overhanging lip 10 may also be provided for safety to eliminate a sharp exposed edge.

Although various minor modifications may be suggested by those skilled in the art, it should be understood that I wish to embody within the scope of the patent warranted hereon, all such embodiments as reasonably and properly come within the scope of my contribution to the art.

I claim as my invention:

1. A protected shelf and tag assembly comprising in combination:

(a) support means;

(b) a shelf projecting outwardly from said support means, said shelf having a merchandise supporting surface having an inner edge adjacent the support means and an outer edge wall;

(c) a removable shelf protector having a planar surface receivable on said merchandise supporting surface and a lip portion overlapping the outer edge wall, said planar surface extending substantially from the shelf supporting surface inner edge outwardly to the lip portion so as to protect substantially an entire depth of the shelf supporting surface, merchandise resting on the shelf protector promoting securement of the shelf protector to the shelf;

(d) tag holding means attached to said lip portion for displaying removable tags containing merchandise related indicia;

(e) said outer edge wall having a tag support member which is positioned between the overlapping lip portion and the outer edge wall of the shelf; and (f) said tag holding means comprising a support member with adhesive means attaching it to the lip portion, said support member having a first locking member protrusion, and a plurality of tag holding members each having a second locking member removably and slidably matable with said first locking member by use of a channel received over the protrusion.

* * * * *